US006243555B1

(12) United States Patent
Herrick et al.

(10) Patent No.: US 6,243,555 B1
(45) Date of Patent: Jun. 5, 2001

(54) REPRODUCTION METHOD AND APPARATUS FOR POST-TRANSFER IMAGE CONDITIONING

(75) Inventors: Diane M. Herrick, Rochester; Thomas N. Tombs; Graham S. Wright, both of Brockport, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/473,403

(22) Filed: Dec. 28, 1999

(51) Int. Cl.[7] ..... G03G 15/16
(52) U.S. Cl. ..... 399/297; 399/302; 399/308
(58) Field of Search ..... 399/297, 302, 399/303, 308

(56) References Cited

U.S. PATENT DOCUMENTS

| | | | | |
|---|---|---|---|---|
| 5,172,172 | * | 12/1992 | Amemiya et al. | 399/303 |
| 5,189,479 | | 2/1993 | Matsuda et al. | 399/300 |
| 5,612,772 | | 3/1997 | Enomoto et al. | 399/315 |
| 5,897,247 | * | 4/1999 | Tombs et al. | 399/308 |
| 5,923,937 | * | 7/1999 | Thompson et al. | 399/302 |
| 6,016,415 | * | 1/2000 | Herrick et al. | 399/162 |
| 6,075,965 | * | 6/2000 | Tombs et al. | 399/308 |
| 6,081,678 | * | 6/2000 | Kato | 399/49 |

FOREIGN PATENT DOCUMENTS

WO 98/04961 2/1998 (WO) .

* cited by examiner

*Primary Examiner*—Fred L Braun
(74) *Attorney, Agent, or Firm*—James D. Leimbach

(57) ABSTRACT

A reproduction apparatus and method provides first and second toner image bearing members (TIBMs). Each of the TIBMs has a respective toner image that is moved through a respective transfer nip with a web that has or supports a toner image receiving surface. Each TIBM in each nip has a predetermined amount of pre-nip wrap by the web and a predetermined amount of post-nip wrap by the web. Electrostatic transfer, preferably in a constant current transfer mode, of a toner image at each transfer nip is made to the receiving surface so that a toner image transferred by the second TIBM is deposited on the receiving surface so as to form a composite image with the toner image transferred to the receiving surface by the first TIBM. Between the nip with the first TIBM and the nip with the second TIBM, a second surface of the web opposite the first surface is subjected to a discharge member at a fixed predetermined potential preferably ground to reduce charge on the web to condition the web for receipt by the receiving surface of a second toner image from the second TIBM.

46 Claims, 4 Drawing Sheets

REPRODUCTION METHOD AND APPARATUS FOR POST-TRANSFER IMAGE CONDITIONING

FIELD OF THE INVENTION

This invention relates to electrostatography and more particularly to a reproduction method and apparatus that employs transfer of toner images to receiver members.

BACKGROUND OF THE INVENTION

In a multicolor electrophotographic (EP) reproduction apparatus comprising two or more image forming stations and an insulating paper transport web, the transfer of a toner image from an image carrier or toner image-bearing member (TIBM), i.e., a photoconductor (PC) or an intermediate transfer member (ITM), to a receiver, electrostatically or mechanically held to the paper transport web, is achieved by use of a constant current supplying device, i.e., a corona charger, brush or roller charger, which sprays or otherwise deposits a constant amount of charge, of opposite polarity from the toner, to the backside of the paper transport web, an example of such an apparatus is described in International published application W098/04961. As the receiver tacked to the paper transport web separates from the image carrier, in addition to the transfer charge located on the backside of the paper transport web, post-nip ionization charge of the same polarity as the toner is sprayed on the toned side of the receiver. For the case of positive wrap, i.e., wrap of the receiver about the image carrier, the magnitude of the post-nip ionization charge sprayed on the front side of the paper transport web defines the polar charge in the area of the receiver. The difference in the magnitudes of front-side and back-side charges defines the net charge in the area of the receiver. Polar charge due to post-nip ionization occurring during transfer at an upstream image forming station adversely impacts subsequent image transfers. FIG. 1 shows the reduction in the efficiency of toner transfer with increasing polar charge, since polar charge reduces the transfer field. As may be seen from FIG. 1, transfer efficiency decreases with increase in polar charge for images at maximum density, or halftones at 141 lines per inch with 40% coverage and even more dramatically for a halftone at 20% coverage. Net charge can cause image disruption during non-controlled air breakdown of the electric field produced by the net charge as the toned image on the receiver comes near a grounded plane.

To circumvent problems due to polar charge and net charge in a known prior art EP color machine wherein a receiver is transported by a paper transport web through the machine there are provided numerous corona chargers to condition the image and the receiver after transfer. Two conditioning chargers apply charge, opposite in polarity from the toner charge, to the front side of the toned receiver. Two conditioning chargers apply charge, opposite in polarity from the transfer charge, to the backside of the receiver. These chargers reduce both the polar charge and the net charge, insuring improved subsequent transfers. However, this image conditioning strategy is costly and produces excessive ozone.

SUMMARY OF THE INVENTION

The invention is directed to providing an inexpensive and easy approach to image conditioning in a multi-color electrostatographic apparatus which utilizes sequential, image forming stations and a paper transport web, the web partially wrapped around a portion of a TIBM in an electrostatic transfer station. In the claims and summary of the invention, reference to first and second toner image-bearing members (TIBMs) implies a relative sequential relationship between these two TIBMs and not that the first and second TIBMs can only be the first and second TIBMs in a series of three or more TIBMs. Thus, the first and second TIBMs could refer to any adjacent pair in a sequence of TIBMs which operate upon a receiver.

In accordance with the invention, there is provided a reproduction method comprising moving each of a first and second toner image bearing members (TIBMs), each of the TIBMs having a respective toner image formed thereon, through a respective transfer nip with a web that has or supports a toner image receiving surface; moving the web through each nip with each TIBM, the web having or supporting on a first surface thereof the toner image receiving surface as the receiving surface is moved through the transfer nip with the first TIBM to the transfer nip with the second TIBM; providing on each TIBM in each nip a predetermined amount of pre-nip wrap by the web and a predetermined amount of post-nip wrap by the web; electrostatically transferring a toner image at each transfer nip to the receiving surface so that a toner image transferred by the second TIBM is deposited on the receiving surface so as to form a composite image with the toner image transferred to the receiving surface by the first TIBM; and between the nip with the first TIBM and the nip with the second TIBM discharging a second surface of the web opposite the first surface with a discharge member at a fixed predetermined potential to reduce charge on the web to condition the web for receipt by the receiving surface of a second toner image from the second TIBM.

In accordance with a second aspect of the invention, there is provided a reproduction apparatus comprising first and second toner image bearing members (TIBMs), each of the TIBMs having a respective toner image formed thereon and each of the TIBMs being in nip relationship with a respective transfer backing member to form a respective transfer nip through which a web that has or supports a toner image receiving surface passes; each TIBM having electrical bias potential between a portion thereof and the respective transfer backing member to urge electrostatic transfer of the toner image at each transfer nip to the receiving surface; and between the nip with the first TIBM and the nip with the second TIBM there is provided near or engaged with a second surface of the web, opposite the first surface, a discharge member at a fixed predetermined potential to reduce charge on the web to condition the web for receipt by the receiving surface of a second toner image by the second TIBM.

In accordance with a third aspect of the invention, there is provided a reproduction method comprising forming on each of first and second primary image-forming members (PIFMs), a respective toner image; transferring the respective toner images respectively to respective first and second intermediate transfer members (ITMs) at respective primary nips; moving each of the first and second ITMs with the respective toner images formed thereon through a respective secondary transfer nip with a web that has or supports a toner image receiving surface; moving the web through each secondary transfer nip with each ITM, the web having or supporting on a first surface thereof the toner image receiving surface as the receiving surface is moved through the secondary transfer nip with the first ITM to the secondary transfer nip with the second ITM; providing on each ITM in each secondary nip a predetermined amount of post-nip wrap by the web; and electrostatically transferring in a constant current transfer mode a toner image at each secondary transfer nip to the receiving surface so that a toner image transferred by the second ITM is deposited on the receiving surface so as to form a composite image with the toner image transferred to the receiving surface by the first ITM.

BRIEF DESCRIPTION OF THE DRAWINGS

In the detailed description of the preferred embodiments of the invention presented below, reference is made to the accompanying drawings, in each of which the relative relationship of the various components are illustrated, it being understood that orientation of the apparatus may be modified.

DETAILED DESCRIPTION OF THE INVENTION

Because apparatus of the type described herein are well known, the present description will be directed in particular to subject matter forming part of, or cooperating more directly with, the present invention.

Figure 2:
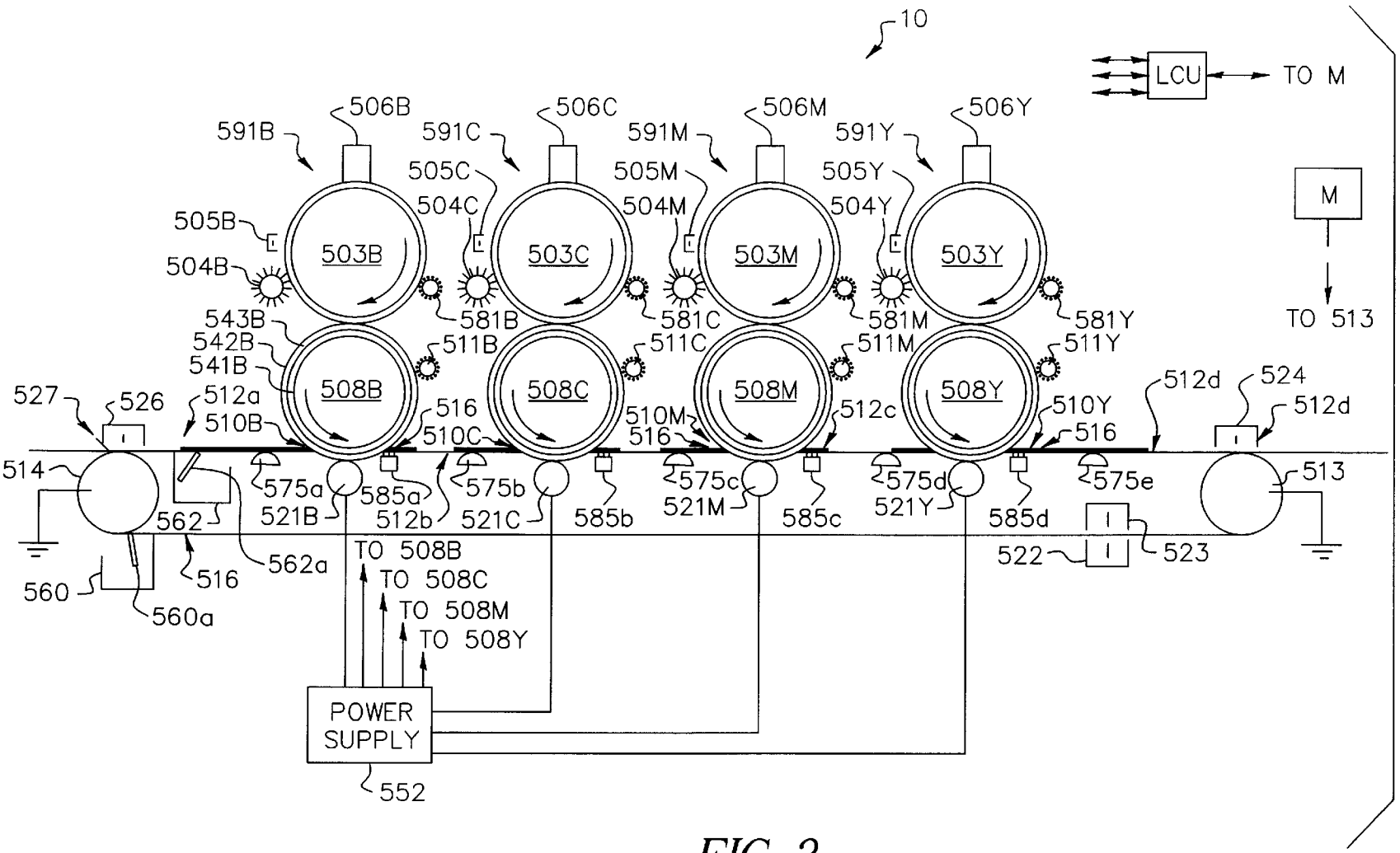
FIG. 2 is a generally schematic side elevational view of a preferred first embodiment of a reproduction apparatus according to the invention.

Referring now to the accompanying drawings, FIG. 2 shows an image forming reproduction apparatus according to a first embodiment of the invention and designated generally by the numeral 10. The reproduction apparatus 10 is in the form of an electrophotographic reproduction apparatus and more particularly a color reproduction apparatus wherein color separation images are formed in each of four color modules and transferred in register to a receiver member as a receiver member is moved through the apparatus while supported on a paper transport web (PTW) 516. A preferred PTW is described in U.S. application Ser. No. 09/199,896, filed in the names of Herrick et al. The apparatus features four color modules although this invention is applicable to two or more such modules.

Each module (591B, 591C, 591M, 591Y) is of similar construction except that as shown one paper transport web 516 which may be in the form of an endless belt operates with all the modules and the receiver member is transported by the PTW 516 from module to module. The elements in FIG. 2 that are similar from module to module have similar reference numerals with a suffix of B, C, M and Y referring to the color module to which it is associated; i.e., black, cyan, magenta and yellow, respectively. Four receiver members or sheets 512*a, b, c* and *d* are shown simultaneously receiving images from the different modules, it being understood as noted above that each receiver member may receive one color image from each module and that in this example up to four color images can be received by each receiver member. The movement of the receiver member with the PTW 516 is such that each color image transferred to the receiver member at the transfer nip of each module is a transfer that is registered with the previous color transfer so that a four-color image formed on the receiver member has the colors in registered superposed relationship on the receiver member. The receiver members are then serially detacked from the PTW and sent to a fusing station (not shown) to fuse or fix the dry toner images to the receiver member. The PTW is reconditioned for reuse by providing charge to both surfaces using, for example, opposed corona chargers 522, 523 which neutralize charge on the two surfaces of the PTW.

Each color module includes a primary image-forming member (PIFM), for example a rotating drum 503B, C, M and Y, respectively. The drums rotate in the directions shown by the arrows and about their respective axes. Each PIFM 503B, C, M and Y has a photoconductive surface, upon which a pigmented marking particle image, or a series of different color marking particle images, is formed. In order to form images, the outer surface of the PIFM is uniformly charged by a primary charger such as a corona charging device 505 B, C, M and Y, respectively or other suitable charger such as roller chargers, brush chargers, etc. The uniformly charged surface is exposed by suitable exposure means, such as for example a laser 506 B, C, M and Y, respectively or more preferably an LED or other electro-optical exposure device or even an optical exposure device to selectively alter the charge on the surface of the PIFM to create an electrostatic latent image corresponding to an image to be reproduced. The electrostatic image is developed by application of pigmented charged marking particles to the latent image bearing photoconductive drum by a development station 581 B, C, M and Y, respectively. The development station has a particular color of pigmented toner marking particles associated respectively therewith. Thus, each module creates a series of different color marking particle images on the respective photoconductive drum. In lieu of a photoconductive drum which is preferred, a photoconductive belt may be used.

As an alternative to electrophotographic recording, there may be used electrographic recording of each primary color image using stylus recorders or other known recording methods for recording a toner image on a dielectric member that is to be transferred electrostatically as described herein. Broadly, the primary image is formed using electrostatography.

Each marking particle image formed on a respective PIFM is transferred electrostatically to an outer surface of a respective secondary or intermediate image transfer member (ITM), for example, an intermediate transfer drum 508 B, C, M and Y, respectively. The PIFMs are each caused to rotate about their respective axes by frictional engagement with a respective ITM. The arrows in the ITMs indicate the directions of rotations. After transfer the toner image is cleaned from the surface of the photoconductive drum by a suitable cleaning device 504 B, C, M and Y, respectively to prepare the surface for reuse for forming subsequent toner images. The intermediate transfer drum or ITM preferably includes a metallic (such as aluminum) conductive core 541 B, C, M and Y, respectively and a compliant blanket layer 543 B, C, M and Y, respectively. The cores 541 C, M and Y and the blanket layers 543 C, M and Y are shown but not identified in FIG. 2 but correspond to similar structure shown and identified for module 591B. The compliant layer is formed of an elastomer such as polyurethane or other materials well noted in the published literature. The elastomer has been doped with sufficient conductive material (such as antistatic particles, ionic conducting materials, or electrically conducting dopants) to have a relatively low resistivity (for example, a bulk or volume electrical resistivity preferably in the range of approximately $10^7$ to $10^{11}$ ohm-cm). Further, the compliant blanket layer is more than 1 mm thick, preferably between 2 mm and 15 mm, and has a Young's modulus in the range of approximately 0.1 MPa to 10 MPa, and more preferably between 1 MPa and 5 MPa. The blanket layer has a bulk or volume electrical resistivity that is preferably between $10^7$–$10^{11}$ ohm-cm. A thin (2 $\mu$m–30 $\mu$m) hard overcoat layer covers the blanket layer and the overcoat layer has a Young's modulus of preferably greater than 100 MPa. The hard overcoat layer may have a higher bulk or volume electrical resistivity than the blanket layer. With such a relatively conductive intermediate image transfer member drum, transfer of the single color marking particle images to the surface of the ITM can be accomplished with a relatively narrow nip width (preferably 2–15 mm) and a relatively modest potential of, for example, 600 volts of suitable polarity applied by a constant voltage potential source (not shown). Different levels of constant voltage can be provided to the different ITMs so that the constant voltage on one ITM differs from that of another ITM in the apparatus.

A single color marking particle image respectively formed on the surface 542B (others not identified) of each intermediate image transfer member drum, is transferred to a toner image receiving surface of a receiver member, which is fed into a nip between the intermediate image transfer member drum and a transfer backing roller (TBR) 521B, C, M and Y, respectively, that is suitably electrically biased by a constant current power supply 552 to induce the charged toner particle image to electrostatically transfer to a receiver sheet. Each TBR is provided with a respective constant current by power supply 552. The transfer backing roller or TBR preferably includes a metallic (such as aluminum) conductive core and a compliant blanket layer. The compliant layer is formed of an elastomer such as polyurethane or other materials well noted in the published literature. The elastomer has been doped with sufficient conductive material (such as antistatic particles, ionic conducting materials, or electrically conducting dopants) to have a bulk or volume electrical resistivity preferably in the range of approximately $10^7$ to $10^{12}$ ohm-cm. The compliant layer is more than 1 mm thick, preferably 2 to 15 mm, and has a Young's modulus in the range of 0.1 MPa to 50 MPa, and preferably 1 to 20 MPa. The TBR may have a thin (2 to 30 $\mu$m) hard overcoat that covers the blanket layer, to aid in cleaning and drive. Although a resistive blanket is preferred, the TBR may be a conductive roller made of aluminum or other metal. The receiver member is fed from a suitable receiver member supply (not shown) and is suitably "tacked" to the PTW 516 and moves serially into each of the nips 510B, C, M and Y where it receives the respective marking particle image in suitable registered relationship to form a composite multicolor image. As is well known, the colored pigments can overlie one another to form areas of colors different from that of the pigments. The receiver member exits the last nip and is transported by a suitable transport mechanism (not shown) to a fuser where the marking particle image is fixed to the receiver member by application of heat and/or pressure and, preferably both. A detack charger 524 may be provided to deposit a neutralizing charge on the receiver member to facilitate separation of the receiver member from the belt 516. The receiver member with the fixed marking particle image is then transported to a remote location for operator retrieval. The respective ITMs are each cleaned by a respective cleaning device 511B, C, M and Y to prepare it for reuse. Although the ITM is preferred to be a drum, a belt may be used instead as an ITM.

Appropriate sensors (not shown) of any well known type, such as mechanical, electrical, or optical sensors for example, are utilized in the reproduction apparatus 10 to provide control signals for the apparatus. Such sensors are located along the receiver member travel path between the receiver member supply through the various nips to the fuser. Further sensors may be associated with the primary image forming member photoconductive drum, the intermediate image transfer member drum, the transfer backing member, and various image processing stations. As such, the sensors detect the location of a receiver member in its travel path, and the position of the primary image forming member photoconductive drum in relation to the image forming processing stations, and respectively produce appropriate signals indicative thereof. Such signals are fed as input information to a logic and control unit LCU including a microprocessor, for example. Based on such signals and a suitable program for the microprocessor, the control unit LCU produces signals to control the timing operation of the various electrostatographic process stations for carrying out the reproduction process and to control drive by motor M of the various drums and belts. The production of a program for a number of commercially available microprocessors, which are suitable for use with the invention, is a conventional skill well understood in the art. The particular details of any such program would, of course, depend on the architecture of the designated microprocessor.

The receiver members utilized with the reproduction apparatus 10 can vary substantially. For example, they can be thin or thick paper stock (coated or uncoated) or transparency stock. As the thickness and/or resistivity of the receiver member stock varies, the resulting change in impedance affects the electric field used in the nips 510B, C, M, Y to urge transfer of the marking particles to the receiver members. Moreover, a variation in relative humidity will vary the conductivity of a paper receiver member, which also affects the impedance and hence changes the transfer field. To overcome these problems, the paper transport belt preferably includes certain characteristics.

The endless belt or web (PTW) 516 is preferably comprised of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton™), polyethylene napthoate, or silicone rubber. Whichever material that is used, such web material may contain an additive, such as an anti-stat (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. The belt may have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt is relatively thin (20 μm–1000 μm, preferably, 50 μm–200 μm and is flexible. It is also envisioned that the invention applies to an electrostatographic color machine wherein a generally continuous paper web receiver is utilized and the need for a separate paper transport web is not required. Such continuous webs are usually supplied from a roll of paper that is supported to allow unwinding of the paper from the roll as the paper passes as a generally continuous sheet through the apparatus.

In feeding a receiver member onto belt 516 charge may be provided on the receiver member by charger 526 to electrostatically attract the receiver member and "tack" it to the belt 516. A blade 527 associated with the charger 526 may be provided to press the receiver member onto the belt and remove any air entrained between the receiver member and the belt.

A receiver member may be engaged at times in more than one image transfer nip and preferably is not in the fuser nip and an image transfer nip simultaneously. The path of the receiver member for serially receiving in transfer the various different color images is generally straight facilitating use with receiver members of different thicknesses.

The endless paper transport web (PTW) 516 is entrained about a plurality of support members. For example, as shown in FIG. 2, the plurality of support members are rollers 513, 514 with preferably roller 513 being driven as shown by motor M to drive the PTW (of course, other support members such as skis or bars would be suitable for use with this invention). Drive to the PTW can frictionally drive the ITMs to rotate the ITMs which in turn causes the PIFMs to be rotated, or additional drives may be provided. The process speed is determined by the velocity of the PTW which is typically 300 mm $sec^{-1}$.

Support structures 575*a, b, c, d* and *e* are provided before entrance and after exit locations of each transfer nip to engage the belt on the backside and alter the straight line path of the belt to provide for wrap of the belt about each respective ITM so that there is wrap of the belt of greater than 1 mm on each side of the nip or at least one side of the nip and preferably the total wrap is less than 20 mm. This wrap allows for a reduced pre-nip ionization and for a post-nip ionization which is controlled by the post-nip wrap. The nip is where the pressure roller contacts the backside of the belt or where no pressure roller is used, where the electrical field is substantially applied. However, the image transfer region of the nip is a smaller region than the total wrap. The wrap of the belt about the ITM also provides a path for the lead edge of the receiver member to follow the curvature of the ITM but separate from engagement with the ITM while moving along a line substantially tangential to the surface of the cylindrical ITM. Pressure applied by the transfer backing rollers (TBRs) 521 B, C, M and Y is upon the backside of the belt 516 and forces the surface of the compliant ITM to conform to the contour of the receiver member during transfer. Preferably, the pressure of each TBR 521 B, C, M and Y on the PTW 516 is 7 pounds per square inch or more. The TBRs may be replaced by corona chargers, biased blades or biased brushes. Substantial pressure is provided in the transfer nip to realize the benefits of the compliant intermediate transfer member which are conformation of the toned image to the receiver member and image content on both a microscopic and macroscopic scale. The pressure may be supplied solely by the transfer biasing mechanism or additional pressure applied by another member such as a roller, shoe, blade or brush.

Equal pre-nip and post-nip wrap angles in all modules can readily be achieved, for example, by placing the support structures at the same elevation and the support structures 575*b, c*, and *d*, substantially half-way between successive modules, thereby providing a post-nip wrap angle for module 591B and a pre-nip wrap angle for module 591C that are approximately equal, and similarly between modules 591C and 591M and between modules 591M and 591Y, the pre-nip wrap angle for 591B and the post-nip wrap angle for 591Y being equivalently set using support structures 575*a* and *e*. It is to be understood that pre-nip and post-nip wrap angles may be set to any convenient values in any of the modules, and may be made to differ module to module by adjustments of the individual elevations of individual support structures or by placing the support structures at points that are not half-way between modules, or both. Moreover, in order to have independent control of pre-nip and post-nip wrap angles within each module, a larger number of support structures may be used, e.g., two support structures per module, one on each side of each transfer nip. Support structures may include skids, bars, rollers, and the like.

Figure 1:
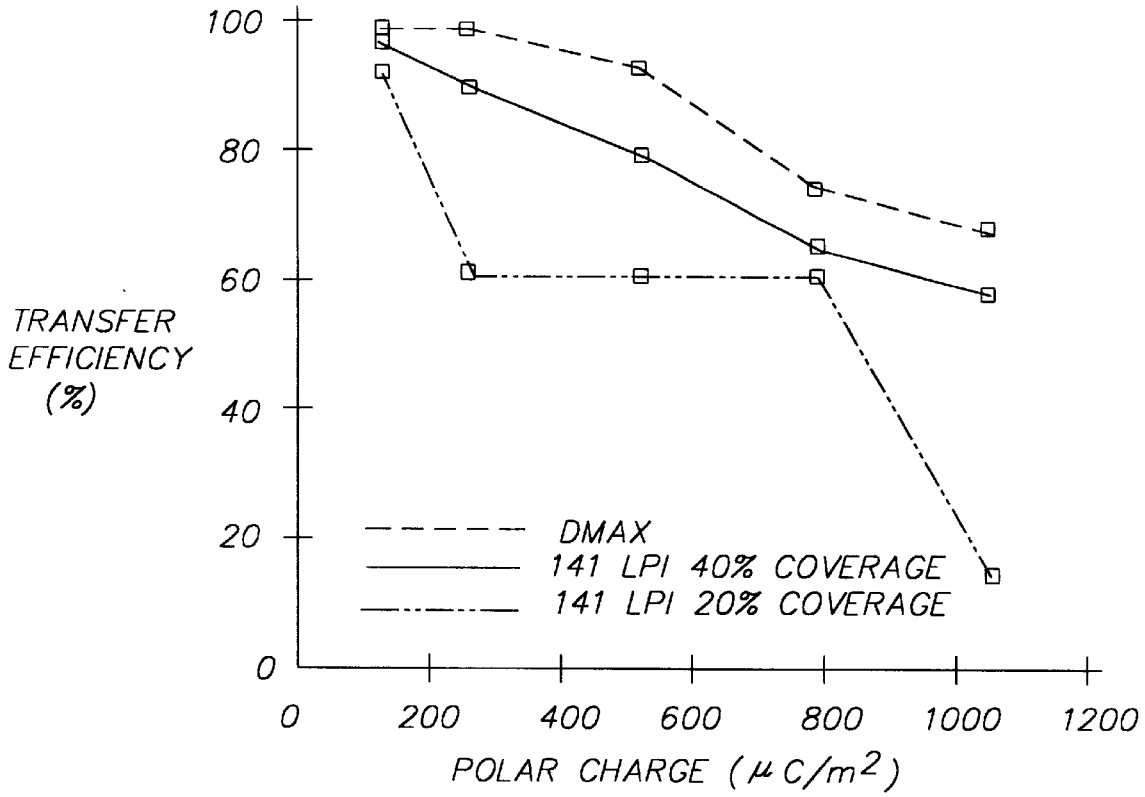
FIG. 1 is a graph illustrating a relationship between polar charge and transfer efficiency in a multicolor electrostatographic reproduction apparatus having plural transfer stations.
Figure 5:
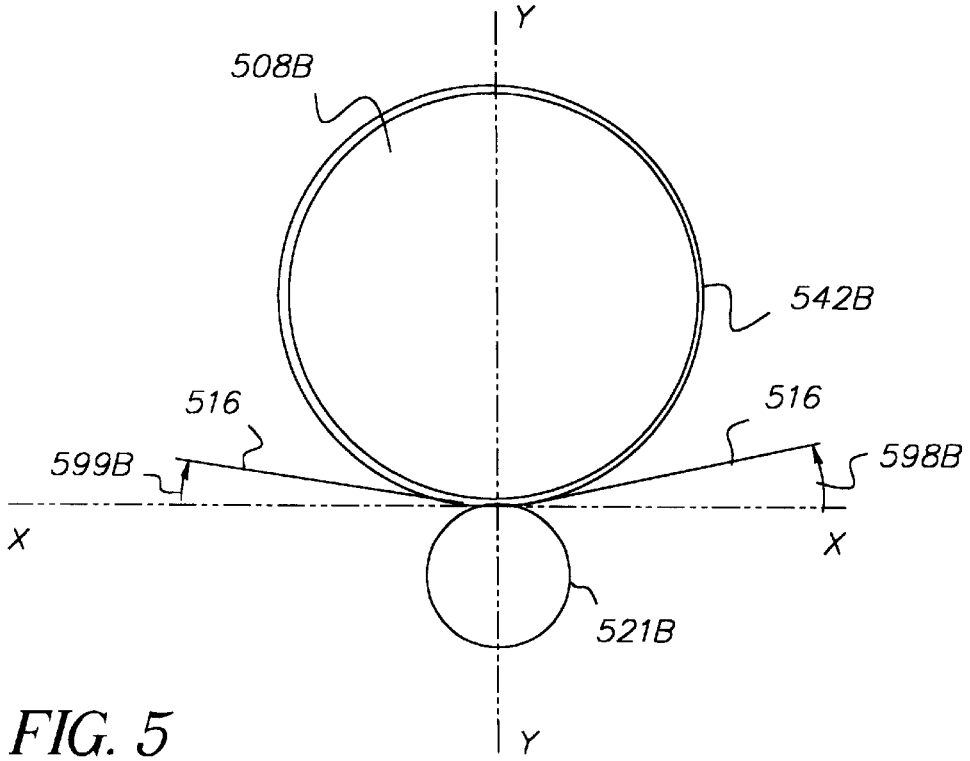
FIG. 5 is a schematic illustration showing wrap angles of a paper transport web passing through a transfer nip.

FIG. 5 shows schematically for one color module how the paper transport web 516 wraps the ITR 508B. Similarly, the web 516 would wrap ITRs 508C, M and Y in the other modules. A positive pre-nip wrap angle is indicated as 599B, the clockwise direction of the arrow showing a positive angular direction away from a dashed line X . . . X which is perpendicular to a dashed line Y . . . Y passing through the centers of rotation of ITM 508B and TBR 521B. A positive post-nip wrap angle referred to herein as $\theta_{wrap}$ is indicated by an arrow 598B and is similarly measured but in an anti-clockwise direction from the line X . . . X. It is preferred that the pre-nip and post-nip wraps are substantially the same, it being understood that a pre-nip wrap angle and a post-nip wrap angle may differ in magnitude, not only within a module, but also module to module.

Figure 3:
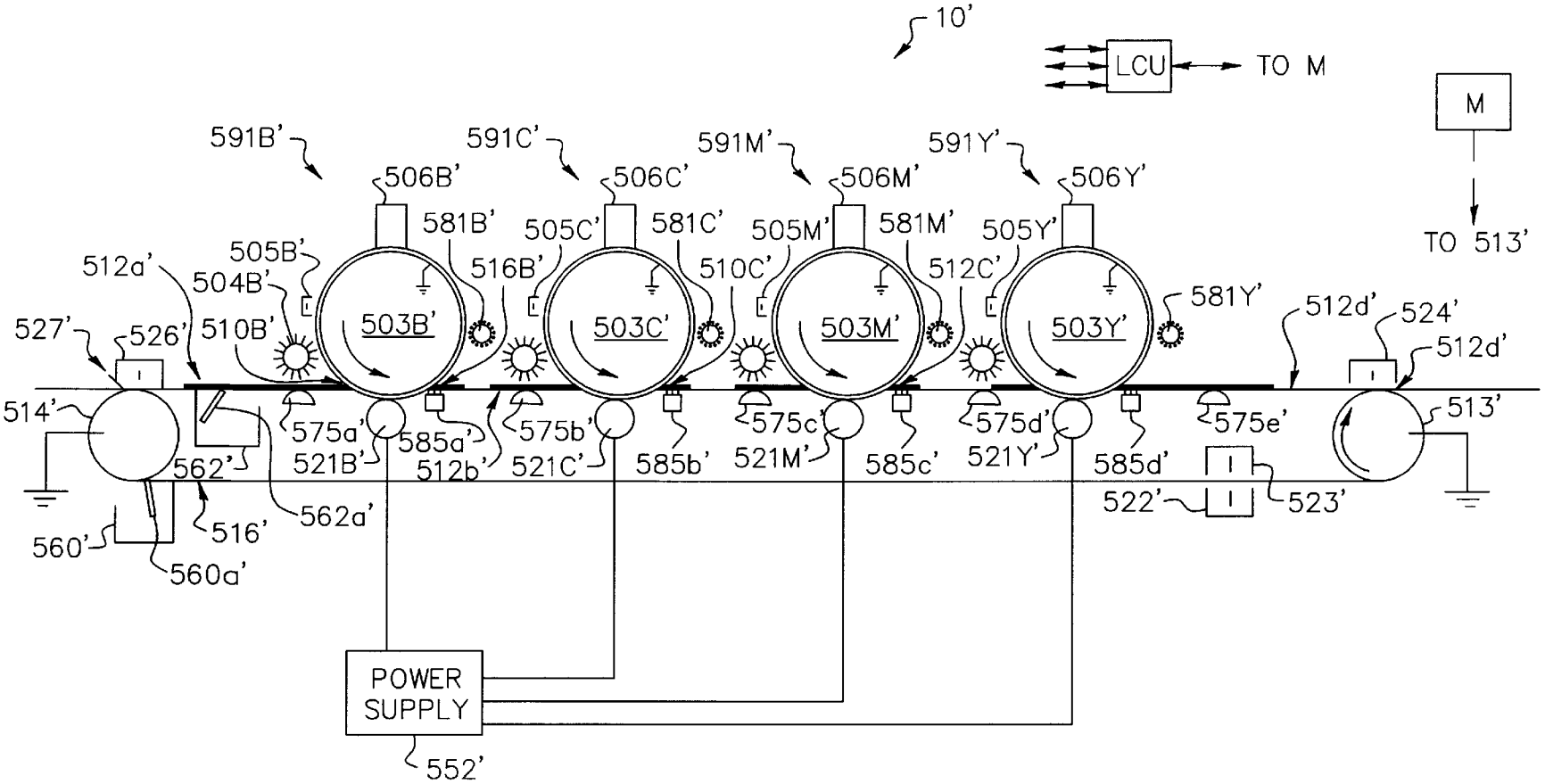
FIG. 3 is a generally schematic side elevational view of a second embodiment of a reproduction apparatus according to the invention.

With reference to FIG. 3, structures shown therein that are similar to structure in FIG. 2 are identified with a prime (') after the reference numbers. In the embodiment of FIG. 3, a toner color separation image of one of each of four colors is formed by each module 591B', 591C', 591M', and 591Y' on respective photoconductive drums 503B', 503C', 503M' and 503Y'. The respective toned color separation images are transferred in registered relationship to a receiver member as the receiver member serially travels or advances from module to module receiving in transfer at each transfer nip (510B' is the only nip designated) a respective toner color separation image. In the embodiment of FIG. 3, the ITMs are not present and direct transfer of each image is made from the respective photoconductive drums to the receiver sheet as the receiver sheet serially advances through the transfer stations while supported by the paper transport web 516'. In both the embodiments of FIGS. 2 and 3, different receiver sheets may be located in different nips simultaneously and at times one receiver sheet may be located in two adjacent nips simultaneously, it being appreciated that the timing of image creation and respective transfers to the receiver sheet is such that proper transfer of images are made so that respective images are transferred in register and as expected.

The geometry and materials of the transfer systems found in such an apparatus tend to minimize post-transfer polar charge per unit area in the area of a receiver tacked to the paper transport web. A polar charge comprises an average charge per unit area having a given polarity on the front surface of a web (or on a receiver located on the front surface of a paper transport web) and an average charge per unit area having equal magnitude and opposite polarity on the back of the web. The amount of post-nip web wrap along an image carrying member, the resistivities of both the intermediate transfer member and the transfer backing roller located behind the web, and the diameters of these rollers are optimized to minimize the amount of post-transfer charge per unit area produced by post-nip ionization on the toned receiver, thus minimizing polar charge per unit area and its adverse affects on subsequent transfers. However, a minimized polar charge per unit area in the area of the receiver increases net charge per unit area, $Q_{net}=|Q_{transfer}|-|Q_{ion}|$, the difference between the magnitude of the constant transfer charge per unit area $Q_{transfer}$ sprayed on the backside of the paper transport web 516, 516' for transfer and the magnitude of the charge per unit area $Q_{ion}$ on the frontside of the receiver after post-nip ionization ceases. Since uncontrolled breakdown to nearby surfaces of net charge on a web is known to cause disruption of a toner image on a receiver carried on the web, a passive discharge device is utilized after transfer to remove the net charge in accordance with the invention. The resulting polar charge per unit area after the net charge has been removed has a magnitude nearly equal to $|Q_{ion}|$. Note that not all of the net charge is typically removed by a passive discharge brush.

Figure 4:
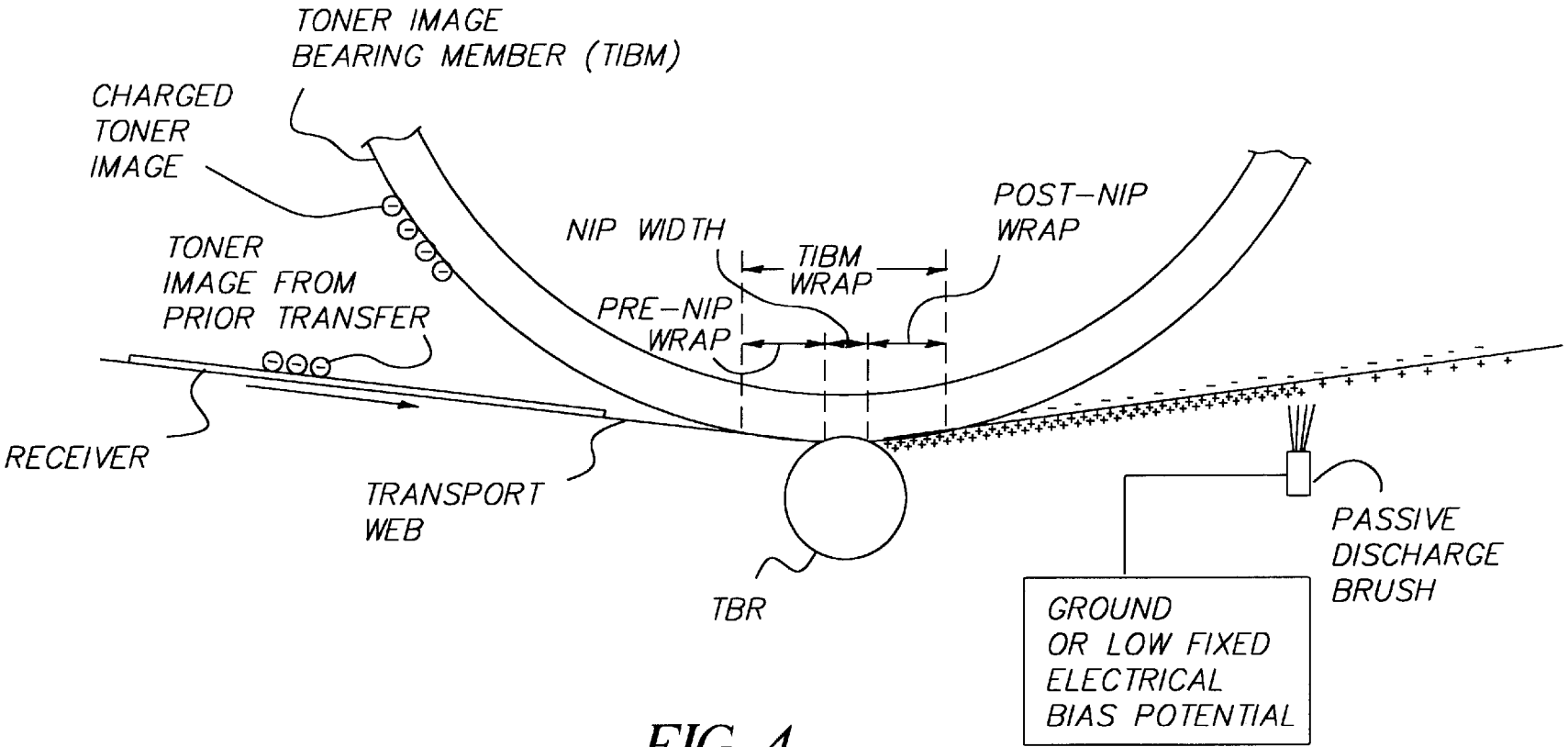
FIG. 4 is an illustration of paper transport web wrap along a toner image carrying member in the apparatus of the invention.

FIG. 4 shows the transfer geometry, with web wrap, and a passive discharge brush located downstream to eliminate net charge. The constant current strategy used for transfer insures at the toner layer an optimum electric field substantially independent of conditions that may vary, including the toner coverage on the image carrier, the variability of the properties of paper or of the paper transport web. Incorporating post-nip wrap of the receiver plus supporting web around the toner image carrying member reduces the polar charge but results in excessive net charge. This excessive net charge is removed with the passive discharge brush located downstream. Therefore, subsequent transfers are improved by the reduction in polar charge and the elimination of net charge caused by the prior transfer.

The transfer configurations described in the above embodiments having an ITM roller should be optimized to minimize polar charge in the area of the receiver, thereby avoiding disrupting subsequent transfers of toner images from intermediate members to receivers as well as avoiding excessively high voltages in subsequent transfers. Mathematical modeling has determined for the first module 591B the following desired relationship which includes the following variables: the post-nip wrap angle, the diameter of the ITM 508B, the diameter of the TBR 521B, the applied transfer voltage, and the resistivities and thicknesses of the component layers of the ITM roller and TBR roller blankets:

$$abs[A/B]>0.01$$

where $A=k_1\theta_{wrap}+k_2L_R+k_3L_R\theta_{wrap}+k_4L_RL_D+k_5L_D\theta_{wrap}+k_6$ and $B=k_7+k_8(V-k_0)+k_9L_R+k_{10}L_D\theta_{wrap}+k_{11}L_RL_D\theta_{wrap}+k_{12}(L_R)^2$ $L_D=\log_{10}[d_{Front}/d_{Back}]$ $L_R=\log_{10}[(C+D)(v)/k_{13})]$ $C=\Sigma[(\rho_F)_i(t_F)_i]$, summed over all the layers of the ITR blanket in the first module($\Omega$ cm$^2$)

$D=\Sigma[(\rho_B)_i(t_B)_i]$, summed over all the layers of the TBR blanket in the first module ($\Omega$ cm$^2$)

In the above relationships:

$\theta_{wrap}$ is the post-nip wrap angle in degrees in the first module,

V is the potential applied in the first module to the ITM minus the potential applied to the TBR (V is positive when toner has positive polarity, and negative when toner has negative polarity), $d_{Front}$ is the diameter of the ITM in the first module (cm), $d_{Back}$ is the diameter of the TBR in the first module (cm), $(\rho_F)_i$ is the resistivity of the ith layer of an ITM multilayer blanket in the first module ($\Omega$ cm), $(\rho_B)_i$ is the resistivity of the ith layer of a TBR multilayer blanket in the first module ($\Omega$ cm), $(t_F)_i$ is the thickness of the ith layer of an ITM multilayer blanket in the first module (cm), $(t_B)_i$ is the thickness of the ith layer of a TBR multilayer blanket in the first module (cm), v is the process speed (cm sec$^{-1}$).

The constants $k_0$–$k_{13}$ have the following respective values:

| | | |
|---|---|---|
| $k_0$ = 1622.5 (V) | $k_1$ = −33.21 (deg$^{-1}$) | $k_2$ = −86.81 |
| $k_3$ = 20.36 (deg$^{-1}$) | $k_4$ = 32.25 | $k_5$ = −8.74 (deg$^{-1}$) |
| $k_6$ = 0.521 | $k_7$ = 197.25 | $k_8$ = ±0.22825 (V$^{-1}$) |
| $k_9$ = 74.7 | $k_{10}$ = 4.516 (deg$^{-1}$) | $k_{11}$ = −6.511 (deg$^{-1}$) |
| $k_{12}$ = −9.12 | $k_{13}$ = 18 × 10$^9$ ($\Omega$ cm$^3$ sec$^{-1}$) | |

$k_0$ and $k_8$ are positive when toner has positive polarity, and negative when toner has negative polarity. Furthermore, $d_{Front}/d_{Back}\geqq 1$ $0°\leqq\theta_{wrap}\leqq +20°$ $10^1\leqq(C+D)\leqq 10^{10}$ $\Omega$ cm$^2$.

It is preferred to have:

$abs[A/B]>0.15$ $d_{Front}/d_{Back}\geqq 3$ $0°\leqq\theta_{wrap}\leqq +5°$ $9\times10^7\leqq(C+D)\leqq 9\times10^9$ $\Omega$ cm$^2$.

In the model, the paper transport web has the following characteristics: a thickness of 100 $\mu$m, a dielectric constant of 3.0, and insulating. The model does not deal explicitly with any pre-nip wrap, and assumes that electric fields half-way through the nip are no longer changing with time, i.e., the situation half-way though the nip corresponds to the initial condition for considering the post-nip optimization. The model also assumes zero charge on an untoned incoming receiver before it reaches the first module 591B. In reality, a receiver that is electrostatically "tacked" to the PTW has an initial polar charge of the order of 100 $\mu$C m$^{-2}$ produced by the corona charger 526, but this does not significantly affect the predictions of the model. The amount of polar charge tends to increase from module to module as a receiver progresses through subsequent modules 591C, 591M and 591Y. Nevertheless, by minimizing polar charge in the first module according to the model, the polar charge laid down in successive modules is also advantageously minimized. It is preferred that all the modules be similar, i.e., same diameters of corresponding rollers, postnip wraps, resistivities and blanket thicknesses and that similar advantages accrue to each module in terms of minimizing polar charge.

Although the above theoretical results can be used to determine suitable values of the parameters for minimizing polar charge, it is however possible that minimization of polar charge using the delineated parameter space may result in conditions producing an insufficiently large transfer field. Hence, a preferred application of the modeling is preferably done under a constraint that a suitable amount of transfer charge per unit area $Q_{transfer}$ be supplied to the rear of the paper transport web to create a sufficiently large transfer electric field for electrostatic transfer of a toner image from an image carrying member to a receiver. A preferred value of $Q_{transfer}$ is in a range 100–400 $\mu$C $m^{-2}$, and more preferably in a range 215–250 $\mu$C $m^{-2}$.

In the embodiment shown in FIG. 2, a preferred post-nip wrap of the paper transport web along the image carrier (ITM roller), utilized to insure that the toned receiver separates from the image carrier sufficiently downstream of the transfer charge supplying member to minimize post-nip ionization, is in a range 1.5–5 mm (see FIG. 4). It is more preferred that the post-nip wrap is about 3 mm ($\theta_{wrap}$ equal to about 2°). A preferred pre-nip wrap (see FIG. 4) is in a range 1.5–5 mm, and a more preferred pre-nip wrap is about 3 mm (pre-nip wrap angle equal to about 2°). The most preferred ITM wrap (see FIG. 4) is in a range 8.5–11 mm. The preferred nip width (contact width of TBR and paper transport web—see FIG. 4) is about 3 mm. The preferred transfer charge supplying member is a roller charger (transfer backing roller 521 and 521') with a preferred diameter of 20–80 mm, running in the constant current mode. The diameters of the image carrying members PC or ITM are preferably in the range of 80–240 mm. The voltage applied by a constant current power supply 552 and 552' to a downstream TBR must be equal to or greater than the voltage applied by a constant current power supply to an upstream roller for the previous transfer. The current supplied by a constant current power supply 552 and 552' to a downstream TBR is approximately equal to the current supplied by a constant current power supply to an upstream roller for the previous transfer. A preferred current per unit length of the transfer nip is in a range 30–120 $\mu$a $m^{-1}$, and more preferably, in a range 65–75 $\mu$a $m^{-1}$. Note that length of the transfer nip is parallel to the axis of rotation of the ITM. The preferred ITM bulk resistivity for the first embodiment shown in FIG. 2 is between $1\times10^8$ and $1\times10^9$ ohm-cm with a blanket thickness in the range of 5–15 mm. The preferred TBR bulk resistivity for the first and second embodiments shown in FIGS. 2 and 3 is between $1\times10^7$ and $1\times10^{11}$ ohm-cm with blanket thickness in the range of 2–10 mm. Speed of the PTW, i.e., process speed, may range from 3 $cmsec^{-1}$ to 333 $cmsec^{-1}$. A passive discharge device, preferably a grounded array of conductive fibers, or possibly a blade or smooth grounded plane or roller, which runs the width of the transport web, is located at a distance greater than or equal to 35mm and more preferably greater than or equal to 50 mm downstream of the immediate prior image forming station and prior to the next image forming station to eliminate the net charge. Preferably the passive discharge device or brush is also located at a distance greater than or equal to 35mm and more preferably greater than or equal to 50mm upstream of the next image-forming station. The passive discharge brush arrays are shown in the first and second embodiments FIGS. 2 and 3 denoted as 585*a–d* and 585*a'–d'*, respectively. Although the preferred passive discharge device is a grounded member which engages or is supported so as to be a few millimeters from the backside of the PTW (516, 516'), when deemed necessary, the discharge device that discharges the backside of the PTW may be maintained at a predetermined, low fixed potential other than ground to effectively remove excessive net charge. As used herein, a low potential on the discharge device means lower than 670 volts or a voltage below a corona onset voltage relative to an uncharged web. The reduction in polar charge with the elimination of the potentially harmful net charge insures successful subsequent transfers, e.g., by keeping the voltage applied to the TBR 521 B, C, M, Y or 521' B, C, M, Y by the constant current power supply 552 or 552' from becoming impractically large. The passive discharge devices 585*a–d*, 585*a'–d'* are preferably not so close to the TBR as to cause a direct current discharge between the discharge device and the TBR due to ionization. This direct current discharge is detrimental to the operation of the transfer system and is avoided by providing sufficient distance between the TBR and the discharge device. Thus, this sufficient distance is in the case of a passive discharge brush and a TBR the spacing between the nominal location of the brush tips to the closest point on the TBR. In the case of a passive discharge brush, it is preferred to have the fibers be relatively short say of 6mm length. The brush fibers are each 14 microns nominal diameter and preferably made of type 304 stainless steel. Adding a thin insulating barrier to the upstream side of the brush may also be effective in reducing leakage current from the TBR to the discharge brush.

In the color reproduction apparatus described herein, the apparatus may also be used to form color images in various combinations of color in lieu of the four-color image described. Fewer color modules may be provided in the apparatus or additional color modules may be provided in the apparatus. While the description herein is directed to formation of a composite resultant image on a receiver sheet formed of plural color images, the invention contemplates that images of different physical types of toner may be combined on a receiver sheet to form a composite resultant image. Thus, a black toner image may be transferred to a receiver sheet wherein the toner image is formed of non-magnetic toner and a second black image formed on the same receiver sheet using a magnetic toner using the transfer apparatus and methods described herein. Alternatively, a module may be provided for placing a clear toner layer on the receiver.

In the described embodiments, the wrap of the belt that supports the receiver member in contact with the TIBM depends on tension in the transport belt. The actual transfer nip where the major portion of the electrical field exists between the TIBM and the transfer backing roller or other counter electrode for transfer of the toner image to the receiver member is smaller than this wrap. Thus, by providing a greater amount of wrap length than the length of the actual transfer nip there is reduced the likelihood of pre-nip transfer and pre-nip ionization particularly where the transport belt is substantially insulative. As noted above, it is preferred to have the wrap be greater than 1 mm beyond the roller nip in at least the pre-nip area. Where a transfer backing pressure roller is used to apply the pressure to the underside of the belt to urge the receiver member into intimate contact with the TIBM at the nip, it is preferred that the pressure roller be of intermediate conductivity, i.e. resistivity of $10^7$–$10^{11}$ ohm-cm; however, transfer backing rollers that are highly conductive, i.e., having conductivity of a metal, also may be used. Other structures, as noted above, in lieu of transfer backing rollers may be used to apply pressure to the web at the nip including members having conductive fibers that are electrically biased and provided with stiffener structure on either side of the brush for applying pressure to the web, or rollers with conductive fibers.

In the embodiments described above, transfer of the toner image to the ITM and from the ITM to the receiver member and generally all toner image transfers are made electrostatically and preferably without addition of heat that would cause the toner to soften. Thus, preferably no fusing occurs upon transfer of the toner images to the receiver member in the nips through which the paper transport belt and receiver member passes. In the forming of plural color images in registration on a receiver sheet, the invention contemplates that plural color toner images may be formed on the same image frame of the photoconductive image member using well known techniques; see, for example Gundlach, U.S. Pat. No. 4,078,929. The primary image-forming member may form images by using photoconductive elements as described or dielectric elements using electrographic recording. The toners used for development are preferably dry toners that are preferably nonmagnetic and the development stations are known as two-component development stations. Single component developers may be used, but are not preferred. While not preferred, liquid toners may also be used.

Other charging means such as rollers may be used instead of the corona wire chargers used for electrostatically holding the receiver member or print media to the web ("tacking") and also for electrically discharging the receiver member.

In the color embodiments described herein, it is preferred to use dry, insulative toner particles having a mean volume weighted diameter of between about 2 $\mu$m and about 9 $\mu$m. The mean volume weighted diameter measured by conventional diameter measuring devices such as Coulter Multisizer, sold by Coulter, Inc. Mean volume weighted diameter is the sum of the mass of each particle times the diameter of a spherical particle of equal mass and density, divided by total particle mass.

Cleaning of the front side and back side of the belt may be provided for such as by wiper blades 560*a* and 562*a* (FIG. 2) or 560*a*', 562*a*' (FIG. 3), respectively. Other cleaning devices may also be used such as web cleaning devices, brushes, etc.

The invention has been described in detail with particular reference to certain preferred embodiments thereof, but it will be understood that variations and modifications can be effected within the spirit and scope of the invention.

What is claimed is:

1. A reproduction method comprising:

moving each of a first and a second toner image bearing members (TIBMs), each of the TIBMs having a respective toner image formed thereon, through a respective transfer nip with a web that has or supports a toner image receiving surface;

moving the web through each nip with each TIBM, the web having or supporting on a first surface thereof the toner image receiving surface as the receiving surface is moved through the transfer nip with the first TIBM to the transfer nip with the second TIBM;

providing on each TIBM in each nip a predetermined amount of pre-nip wrap by the web and a predetermined amount of post-nip wrap by the web;

electrostatically transferring by application of a first electric charge having a first polarity to a second surface of the web opposite the first surface, a toner image at each transfer nip to the receiving surface so that a toner image transferred by the second TIBM is deposited on the receiving surface so as to form a composite image with the toner image transferred to the receiving surface by the first TIBM, wherein a second electric charge having a second polarity opposite the first polarity is applied to the first surface after each transfer nip, the second polarity having a different magnitude than the first polarity; and between the nip with the first TIBM and the nip with the second TIBM discharging a second surface of the web opposite the first surface with a discharge member at a fixed predetermined potential to reduce charge on the web to condition the web for receipt by the receiving surface of a second toner image from the second TIBM.

2. The method of claim 1 wherein the first and second TIBMs are each in the form of a drum or roller and the second surface of the web is engaged by a first transfer backing drum or roller to form a nip with the first TIBM, and the ratio $d_{Front}/d_{Back}$ of the diameters of the first TIBM and the first transfer backing roller (TBR), wherein $d_{Front}$ is the diameter of the first TIBM and $d_{Back}$ is the diameter of the first transfer backing roller, is $d_{Front}/d_{Back} \geqq 1$ and providing an electrical potential difference between the first TIBM and the first TBR to urge transfer of the toner image from the TIBM to the TBR.

3. The method of claim 2 wherein $d_{Front}/d_{Back} \geqq 3$.

4. The method of claim 3 wherein a post-nip wrap angle $\theta_{wrap}$ of the web about the first TIBM is $0° \leqq \theta_{wrap} \leqq +20°$.

5. The method of claim 3 wherein a post-nip wrap angle $\theta_{wrap}$ of the web about the first TIBM is $0° \leqq \theta_{wrap} \leqq +5°$.

6. The method of claim 3 wherein the receiving surface is a surface of a discrete sheet that is supported upon the web.

7. The method of claim 3 wherein the first TIBM and the first TBR each include a blanket comprising one or more layers and $1\times10^1 \leqq (C+D) \leqq 1\times10^{10}$ ohm-cm$^2$, where $C=\Sigma[(\rho_F)_i(t_F)_i]$ summed over all the layers of the first TIBM blanket and $D=\Sigma[(\rho_B)_i(t_B)_i]$ summed over all the layers of the first TBR blanket and wherein $(\rho_F)_i$ is the resistivity measured in Ω cm of the ith layer of the first TIBM blanket, $(\rho_B)_i$ is the resistivity measured in Ω cm of the ith layer of the first TBR blanket, $(t_F)_i$ is the thickness measured in cm of the ith layer of the first TIBM blanket, and $(t_B)_i$ is the thickness measured in cm of the ith layer of the first TBR blanket.

8. The method of claim 3 wherein the first TIBM and the first TBR each include a blanket comprising one or more layers and $9\times10^7 \leqq (C+D) \leqq 9\times10^9$ ohm-cm$^2$, where $C=\Sigma[(\rho_F)_i(t_F)_i]$ summed over all the layers of the first TIBM and $D=\Sigma[(\rho_B)_i(t_B)_i]$ summed over all the layers of the first TBR blanket and wherein $(\rho_F)_i$ is the resistivity measured in Ω cm of the ith layer of the first TIBM blanket, $(\rho_B)_i$ is the resistivity measured in Ω cm of the ith layer of the first TBR blanket, $(t_F)_i$ is the thickness measured in cm of the ith layer of the first TIBM blanket, and $(t_B)_i$ is the thickness measured in cm of the ith layer of the first TBR blanket and the web has a bulk resistivity greater than $1\times10^5$ Ω cm.

9. The method of claim 2 wherein the first TIBM and the first TBR each include a blanket comprising one or more layers and $1\times10^1 \leqq (C+D) \leqq 1\times10^{10}$ ohm-cm$^2$, where $C=\Sigma[(\rho_F)_i(t_F)_i]$ summed over all the layers of the first TIBM blanket and $D=\Sigma[(\rho_B)_i(t_B)_i]$ summed over all the layers of the first TBR blanket and wherein further $(\rho_F)_i$ is the resistivity measured in Ω cm of the ith layer of the first TIBM blanket, $(\rho_B)_i$ is the resistivity measured in Ω cm of the ith layer of the first TBR blanket, $(t_F)_i$ is the thickness measured in cm of the ith layer of the first TIBM blanket, and $(t_B)_i$ is the thickness measured in cm of the ith layer of the first TBR blanket.

10. The method of claim 9 wherein the blanket of the first TIBM and the blanket of the first TBR each include multilayers.

11. The method of claim 2 wherein the first TIBM and the first TBR each include a blanket comprising one or more layers and $9\times10^7 \leqq (C+D) \leqq 9\times10^9$ ohm-cm$^2$, where $C=\Sigma[(\rho_F)_i(t_F)_i]$ summed over all the layers of the first TIBM and $D=\Sigma[(\rho_B)_i(t_B)_i]$ summed over all the layers of the first TBR blanket and wherein $(\rho_F)_i$ is the resistivity measured in Ω cm of the ith layer of the first TIBM blanket, $(\rho_B)_i$ is the resistivity measured in Ω cm of the ith layer of the first TBR blanket, $(t_F)_i$ is the thickness measured in cm of the ith layer of the first TIBM blanket, and $(t_B)_i$ is the thickness measured in cm of the ith layer of the first TBR blanket.

12. The method of claim 2 wherein the discharge member is located at least 35 mm downstream of the nip with the first TIBM and at least 35 mm upstream of the nip with the second TIBM.

13. The method of claim 1 wherein the discharge member is a conductive brush and the web has a bulk resistivity greater than $1\times10^5$ Ω cm.

14. The method of claim 1 wherein the discharge member is at ground potential and the web has a bulk resistivity greater than $1\times10^5$ Ω cm.

15. The method of claim 1 wherein the discharge member is at a low fixed potential other than ground.

16. The method of claim 1 wherein the receiving surface is a surface of a generally continuous web.

17. The method of claim 1 and including forming a respective toner image on a primary image forming member and transferring the respective toner image to a respective one of the TIBMs.

18. The method of claim 1 wherein the toner image is transferred to the first TIBM using a constant voltage potential applied to the TIBM.

19. The method of claim 1 wherein transfer charge per unit area is supplied to a second surface of the web opposite that of the first surface and the transfer charge $Q_{transfer}$ is in a range 100 to 400 $\mu Cm^{-2}$.

20. The method of claim 19 wherein current per unit length of the transfer nip is in a range of 30–120 $\mu a\ m^{-1}$.

21. The method of claim 1 wherein transfer charge per unit area is supplied to a second surface of the web opposite that of the first surface and the transfer charge $Q_{transfer}$ is in a range 100 to 400 $\mu Cm^{-2}$.

22. The method of claim 1 wherein in the step of electrostatically transferring a toner image at each transfer nip to the receiving surface, the transfer at each such nip occurs in response to a transfer charge supplying member providing charge while operating in a constant current mode.

23. The method of claim 22 wherein the first and second TIBMs are each in the form of a drum or roller and the second surface of the web is engaged by a first transfer backing drum or roller to form a nip with the first TIBM, and the ratio $d_{Front}/d_{Back}$ of the diameters of the first TIBM and the first transfer backing roller (TBR), wherein $d_{Front}$ is the diameter of the first TIBM and $d_{Back}$ is the diameter of the first transfer backing roller, is $d_{Front}/d_{Back}\geqq1$ and providing an electrical potential difference between the first TIBM and the first TBR to urge transfer of the toner image from the TIBM to the TBR.

24. The method of claim 23 wherein $d_{Front}/d_{Back}\geqq3$.

25. The method of claim 24 wherein a post-nip wrap angle $\theta_{wrap}$ of the web about the first TIBM is $0°\leqq\theta_{wrap}\leqq+20°$.

26. The method of claim 24 wherein a post-nip wrap angle $\theta_{wrap}$ of the web about the first TIBM is $0°\leqq\theta_{wrap}\leqq+5°$.

27. The method of claim 24 wherein the first TIBM and the first TBR each include a blanket comprising one or more layers and $1\times10^1\leqq(C+D)\leqq1\times10^{10}$ ohm-cm$^2$, where $C=\Sigma[(\rho_F)_i(t_F)_i]$ summed over all the layers of the first TIBM blanket and $D=\Sigma[(\rho_B)_i(t_B)_i]$ summed over all the layers of the first TBR blanket and wherein $(\rho_F)_i$ is the resistivity measured in Ω cm of the ith layer of the first TIBM blanket, $(\rho_B)_i$ is the resistivity measured in Ω cm of the ith layer of the first TBR blanket, $(t_F)_i$ is the thickness measured in cm of the ith layer of the first TIBM blanket, and $(t_B)_i$ is the thickness measured in cm of the ith layer of the first TBR blanket.

28. The method of claim 23 wherein the first TIBM and the first TBR each include a blanket comprising one or more layers and $1\times10^1\leqq(C+D)\leqq1\times10^{10}$ ohm-cm$^2$, where $C=\Sigma[(\rho_F)_i(t_F)_i]$ summed over all the layers of the first TIBM blanket and $D=\Sigma[(\rho_B)_i(t_B)_i]$ summed over all the layers of the first TBR blanket and wherein further $(\rho_F)_i$ is the resistivity measured in Ω cm of the ith layer of the first TIBM blanket, $(\rho_B)_i$ is the resistivity measured in Ω cm of the ith layer of the first TBR blanket, $(t_F)_i$ is the thickness measured in cm of the ith layer of the first TIBM blanket, and $(t_B)_i$ is the thickness measured in cm of the ith layer of the first TBR blanket.

29. A reproduction apparatus comprising:

first and second toner image bearing members (TIBMs), each of the TIBMs having a respective toner image formed thereon and each of the TIBMs being in nip relationship with a respective transfer backing member to form a respective transfer nip through which a web that has or supports a toner image receiving surface passes;

each TIBM having electrical bias of a first potential between a portion thereof and the respective transfer backing member to urge electrostatic transfer of the toner image at each transfer nip to the receiving surface, and wherein a second potential is supplied to the receiving surface as it exists each transfer nip; and between the nip with the first TIBM and the nip with the second TIBM there is provided near or engaged with a second surface of the web, opposite the first surface, a discharge member at a fixed predetermined low potential to reduce charge on the web to condition the web for receipt by the receiving surface of a second toner image by the second TIBM.

30. The apparatus of claim 29 wherein the first and second TIBMs are each in the form of a drum or roller and each transfer backing member is in the form of a drum or roller and the second surface of the web is engaged by a transfer backing drum or roller to form a nip with the first TIBM, and the ratio of the diameters of the first TIBM and the first transfer backing roller (TBR) $d_{Front}/d_{Back}$, wherein $d_{Front}$ is the diameter of the first TIBM and $d_{Back}$ is the diameter of the first transfer backing roller, is $d_{Front}/d_{Back}\geqq1$.

31. The apparatus of claim 30 wherein $d_{Front}/d_{Back}\geqq3$.

32. The apparatus of claim 31 wherein a wrap angle $\theta_{wrap}$ of the web about the first TIBM is $0°\leqq\theta_{wrap}\leqq+20°$.

33. The apparatus of claim 32 wherein the first TIBM and the first TBR each include a blanket comprising one or more layers and $1\times10^1\leqq(C+D)\leqq1\times10^{10}$ ohm-cm$^2$, where $C=\Sigma[(\rho_F)_i(t_F)_i]$ summed over all the layers of the first TIBM blanket and $D=\Sigma[(\rho_B)_i(t_B)_i]$ summed over all the layers of the first TBR blanket and wherein further $(\rho_F)_i$ is the resistivity measured in Ω cm of the ith layer of the first TIBM blanket, $(\rho_B)_i$ is the resistivity measured in Ω cm of the ith layer of the first TBR blanket, $(t_F)_i$ is the thickness measured in cm of the ith layer of the first TIBM blanket, and $(t_B)_i$ is the thickness of the ith layer measured in cm of the first TBR blanket.

34. The apparatus of claim 31 wherein a wrap angle $\theta_{wrap}$ of the web about the first TIBM is $0°\leqq\theta_{wrap}\leqq+5°$.

35. The apparatus of claim 31 wherein the first TIBM and the first TBR each include a blanket multilayer comprising two or more layers and $9\times10^7 \leqq (C+D) \leqq 9\times10^9$ ohm-cm$^2$, where $C=\Sigma[(\rho_F)_i(t_F)_i]$ summed over all the layers of the first TIBM blanket and $D=\Sigma[(\rho_B)_i(t_B)_i]$ summed over all the layers of the first TBR blanket and wherein further $(\rho_F)_i$ is the resistivity measured in Ω cm of the ith layer of the first TIBM multilayer blanket, $(\rho_B)_i$ is the resistivity measured in Ω cm of the ith layer of the first TBR multilayer blanket, $(t_F)_i$ is the thickness measured in cm of the ith layer of the first TIBM multilayer blanket, and $(t_B)_i$ is the thickness measured in cm of the ith layer of the first TBR multilayer blanket.

36.The apparatus of claim 29 wherein a constant current is provided by a transfer backing member.

37.The apparatus of claim 36 wherein the first TIBM is an intermediate transfer member and the toner image is transferred to the first TIBM by providing a constant voltage potential to the first TIBM.

38. A reproduction method comprising:

forming on each of first and second primary image-forming members (PIFMs), a respective toner image;

transferring the respective toner images respectively to respective first and second intermediate transfer members (ITMs) at respective primary nips;

moving each of the first and second ITMs with the respective toner images formed thereon through a respective secondary transfer nip with a web that has or supports a toner image receiving surface;

moving the web through each secondary transfer nip with each ITM, the web having or supporting on a first surface thereof the toner image receiving surface as the receiving surface is moved through the secondary transfer nip with the first ITM to the secondary transfer nip with the second ITM;

providing on each ITM in each secondary nip a predetermined amount of post-nip wrap by the web;

electrostatically transferring by application of a first potential a toner image at each secondary transfer nip to the receiving surface so that a toner image transferred by the second ITM is deposited on the receiving surface so as to form a composite image with the toner image transferred to the receiving surface by the first ITM, wherein a second potential opposite the first potential is supplied to the receiving surface as it exits the secondary transfer nip; and discharging the first potential after the second potential is supplied.

39. The method of claim 38 wherein the discharging step further comprises between the nip with the first TIBM and the nip with the second TIBM discharging a second surface of the web opposite the first surface with a discharge member at a fixed predetermined potential to reduce charge on the web to condition the web for receipt by the receiving surface of a second toner image from the second TIBM.

40. A reproduction method comprising:

providing a first and a second toner image bearing members (TIBMs) with each of the TIBMs having a respective transfer nip with a web, the web supporting a toner image receiving surface on a first surface of the web;

forming a toner image on the TIBMs;

moving the web through the respective transfer nips with the toner image receiving surface on a first surface of the web;

providing a predetermined amount of pre-nip wrap by the web and a predetermined amount of post-nip wrap by the web on each of the TIBMs in each of the nips;

electrostatically transferring, a toner image to the receiving surface at the transfer nip, wherein a first polarity of electric charge is applied to said receiving surface and a second polarity of electric charge opposite the first polarity of electric charge is applied to a second surface of the web as the web moves past the first transfer nip, the second polarity of electric charge having a different magnitude than the first polarity of electric charge; and discharging net charge residing on the second surface of the web with a discharge member at a fixed predetermined potential in a location between the nip with the first TIBM and the nip with the second TIBM.

41. The method of claim 40 wherein the step of providing a first and a second toner image bearing members further comprises the first and second TIBMs each being in the form of a drum or roller and each transfer backing member is in the form of a drum or roller and the second surface of the web is engaged by a transfer backing drum or roller to form a nip with the first TIBM, and the ratio of the diameters of the first TIBM and the first transfer backing roller (TBR) $d_{Front}/d_{Back}$, wherein $d_{Front}$ is the diameter of the first TIBM and $d_{Back}$ is the diameter of the first transfer backing roller, is $d_{Front}/d_{Back} \geqq 1$.

42. The method of claim 40 wherein the step of providing further comprises $d_{Front}/d_{Back} \geqq 3$.

43. The method of claim 40 wherein the step of providing further comprises a wrap angle $\theta_{wrap}$ of the web about the first TIBM is $0° \leqq \theta_{wrap} \leqq +20°$.

44. The method of claim 40 wherein the step of providing further comprises a wrap angle $\theta_{wrap}$ of the web about the first TIBM is $0° \leqq \theta_{wrap} \leqq +5°$.

45. The method of claim 40 wherein the step of electrostatically transferring further comprises transferring the toner image by application of the first polarity of electric charge to a first surface of the web, and the second polarity is applied to the second surface of the web opposite the first surface.

46. The method of claim 40 wherein the step of discharging removes a substantial amount of the net charge.

* * * * *